US005560210A

United States Patent [19]

Bronicki

[11] Patent Number: 5,560,210

[45] Date of Patent: Oct. 1, 1996

[54] RANKINE CYCLE POWER PLANT UTILIZING AN ORGAN FLUID AND METHOD FOR USING THE SAME

[75] Inventor: Lucien Y. Bronicki, Yavne, Israel

[73] Assignee: Ormat Turbines (1965) Ltd., Yavne, Israel

[21] Appl. No.: 428,846

[22] Filed: Apr. 25, 1995

Related U.S. Application Data

[63] Continuation of Ser. No. 261,014, Jun. 14, 1994, abandoned, which is a continuation of Ser. No. 989,916, Dec. 11, 1992, abandoned, which is a continuation of Ser. No. 636,110, Dec. 31, 1990, abandoned.

[51] Int. Cl.[6] ..... F01K 17/00

[52] U.S. Cl. ..... 60/648; 60/649; 60/660; 60/673

[58] Field of Search ..... 60/648, 649, 651, 60/660, 671, 673

[56] References Cited

U.S. PATENT DOCUMENTS

| | | | |
|---|---|---|---|
| 211,836 | 2/1879 | Connelly | 60/651 |
| 279,270 | 6/1883 | Ofeldt | 60/651 |
| 933,022 | 8/1909 | Danckwardt | 60/671 |
| 3,195,304 | 7/1965 | Stern, et al. | 60/649 |
| 3,769,789 | 11/1973 | Niggemann | 60/664 |
| 3,842,593 | 10/1974 | Bronicki et al. | 60/671 |
| 4,179,898 | 12/1979 | Vakil | 62/114 |
| 4,195,485 | 4/1980 | Brinkerhoff | 60/649 |
| 4,295,335 | 10/1981 | Brinkerhoff | 60/673 |
| 4,471,619 | 9/1984 | Nolley, Jr. | 60/649 X |
| 4,489,563 | 12/1984 | Kalina | 60/673 |
| 4,534,175 | 8/1985 | Kogan et al. | 60/649 |
| 4,537,032 | 8/1985 | Kaplan | 60/662 |
| 4,729,226 | 3/1988 | Rosado | 60/649 |

FOREIGN PATENT DOCUMENTS

| | | |
|---|---|---|
| 0670497 | 8/1929 | France . |
| 0670033 | 8/1929 | France . |
| 0036031 | 12/1929 | France . |
| 2202231 | 5/1974 | France . |
| 2190912 | 12/1987 | United Kingdom . |

OTHER PUBLICATIONS

Aripo Search Report, Feb. 8, 1993.

English Language Abstract of JP–57173512, Jan. 22, 1983.

French Search Report and Annex, Jan. 22, 1993.

Hungarian Office Action, Hungarian Patent Office, Jan. 18, 1995, (no translation).

*Thermal Power Plants I,* Lévai, András, pp. 417–419 and 600–605, (no translation), no publication date given.

Israeli Search Report and English Translation thereof.

"18.2 Conducting the chemically gained make–up water to the system", is the translation of the document marked Levai, Andras—Thermal Power Plants I, pp. 417–419, no publication date.

"9.231 Dimensioning of water reserves for power plants" is the translation of the document marked Levai Andras—Thermal Power Plants II, pp. 600–605, no publication date.

*Primary Examiner*—Stephen F. Husar
*Attorney, Agent, or Firm*—Donald M. Sandler

[57] ABSTRACT

A Rankine cycle power plant has a vaporizer member responsive to heat input for vaporizing a working fluid and producing vaporized working fluid, a turbogenerator responsive to vaporized working fluid for generating power and producing heat depleted working fluid, a condenser member responsive to said heat depleted working fluid for condensing the same and producing condensate, and suitable piping for returning said condensate to the vaporizer. The working fluid is in the form of a liquid having a plurality of fractions; at least one fraction is distilled from said liquid to produce a distillated fluid. It is this distillated fluid that is supplied to the power plant as the working fluid.

32 Claims, 2 Drawing Sheets

RANKINE CYCLE POWER PLANT UTILIZING AN ORGAN FLUID AND METHOD FOR USING THE SAME

This application is a continuation of application Ser. No. 08/261,034, filed Jun. 14, 1994, now abandoned, which is a continuation of 07/989,916, filed Dec. 11, 1992, now abandoned, which is a continuation of 07/636,110, filed Dec. 31, 1990, now abandoned.

TECHNICAL FIELD

This invention relates to a Rankine cycle power plant utilizing an organic fluid, and to a method for using the same.

BACKGROUND ART

Power plants that operate on the Rankine cycle utilizing an organic fluid are well known. In such plants, the organic fluid is vaporized in a vaporizer or boiler using heat from burning fuel, a geothermal source, or an industrial process; and the vaporized working fluid is expanded in a turbogenerator for producing power and heat depleted working fluid which is condensed in an air or water cooled condenser to produce liquid working fluid that is returned by a pump to the vaporizer.

The working fluid is selected to have the proper thermodynamic properties for the cycle, such as heat capacity, stability at the working temperatures, etc., and to be compatible with the metals used in conventional turbine installations. In addition, the working fluid must exhibit good lubricating properties because, conventionally, the turbine, as well as the generator coupled thereto, are in a hermetically sealed canister within which liquid working fluid from the condenser is used as a lubricant.

Generally, the working fluid will be a hydrocarbon, such as pentane, or hexane, or an isomer thereof such as isopentane or isohexane. Other well defined chemicals are also used. But in each case, the working fluid is a commercially available, commercially pure material that has well defined and known properties that are utilized in the design of the hardware of the power plant. Sometimes, mixtures of hydrocarbon fluids are used to take advantage of special properties of the mixtures as described in U.S. Pat. No. 3,842,593 where a specific mixture of hydrocarbons provides the power plant with the capability of operating under ambient conditions that would not permit use of a pure material.

Because the manufacturer of an organic fluid Rankine cycle power plant must guarantee that it will produce a predetermined electrical output from a source producing a predetermined amount of heat per unit time, the selected working fluid, or mixture of fluids, must have well defined physical properties. That the chosen fluid or fluids will have these properties is ensured by utilizing commercially pure fluids that conform to international standards. These fluids are readily available in most parts of the world; but there any many places in the world where suitable pure fluids are exorbitantly expensive, or when used in a power plant environment create governmental regulatory problems because of lack of historical precedent for their use under such conditions.

Some organic fluids theoretically capable of being used in a power plant environment are considerably less expensive, or more readily available, than those usually employed in power plants, but these fluids are usually mixtures whose pressure-volume-temperature characteristics are unknown, or vary widely from place to place and from time to time. As a consequence, the designer of the power plant can never be certain that such fluids will perform in a power plant in the predictable ways that a pure fluid whose properties are established will perform. For example, the motor fuel gasoline is one of the most ubiquitous fluids in the world, from highly industrialized countries to the poorest third world countries. In some countries, the availability of gasoline exceeds that of water, and public acceptance of and government regulations on the storing and use of gasoline are well established as compared with many of what seem to lay persons as the exotic organic fluids that have been proposed for Rankine cycle power plants. However, the use of gasoline or other hydrocarbon comprising a plurality of fractions is not a viable choice for an organic fluid Rankine cycle power plant because of the uncertainty of the thermodynamic properties of a particular batch of gasoline in a particular place in the world at a particular time. The designer can not know beforehand the thermodynamic properties of a batch of gasoline that will be delivered to a plant at start-up or later as make-up working fluid; and thus, his design can not take into account the possible variations that can occur. As a consequence, gasoline is rejected out of hand by a designer.

It is an object of the present invention to provide a method of and means for using well known, readily available, acceptable, commercial organic fluids, such as gasolines, in a Rankine cycle power plant regardless of the possible variations in thermodynamic properties from time to time and from place to place.

BRIEF DESCRIPTION OF THE INVENTION

The present invention is concerned with operating a Rankine cycle power plant of the type having a vaporizer member responsive to heat input for vaporizing a working fluid and producing vaporized working fluid, a turbogenerator responsive to vaporized working fluid for generating power and producing heat depleted working fluid, a condenser member responsive to said heat depleted working fluid for condensing the same and producing condensate, and means for returning said condensate to the vaporizer. The working fluid is in the form of a liquid having a plurality of fractions; and the present invention provides for distilling at least one fraction from said liquid to produce a distillated fluid. It is this distillated fluid that is supplied to the power plant as the working fluid.

The distillated fluid is a liquid that is introduced into the power plant and operated therewith; and at least one member of the power plant, either the vaporizer member, or the condenser member, or both, is utilized for distilling a fraction from said liquid to produce said distillated fluid. In such case, the last mentioned fraction is removed from the power plant whose operation is thereafter continued using the distillated fluid. The result is that the working fluid relied upon for steady state operation is the main fraction of the liquid whose thermodynamic properties are well known and reproducible.

Preferably, the liquid is gasoline. The removal of low boiling point fractions by the vaporizer member, and the high boiling point fractions by the condenser member will result in a fluid whose properties are well known. Alternatively, high boiling point fractions can be removed by the vaporizer member, and low boiling point fractions can be removed by the condenser. Thus, even though the properties of the liquid before the power plant began operation were unknown, or known to only a small degree, after the distillation procedures are carried out using the vaporizer member and the condenser member as fractionating columns, and after the higher and lower boiling point fractions are removed, the remaining working fluid will perform in a predictable manner that enables the power plant to produce rated power.

In a modification of the invention, the temperature and pressure in the members is monitored, and the amounts of said fractions in said distillate are adjusted in accordance with the monitored temperature and pressure in said members such that the volume flow through the power plant is kept substantially constant.

BRIEF DESCRIPTION OF THE DRAWINGS

An embodiment of the present invention is shown by way of example in the accompanying drawing wherein.

DETAILED DESCRIPTION

Figure 1:
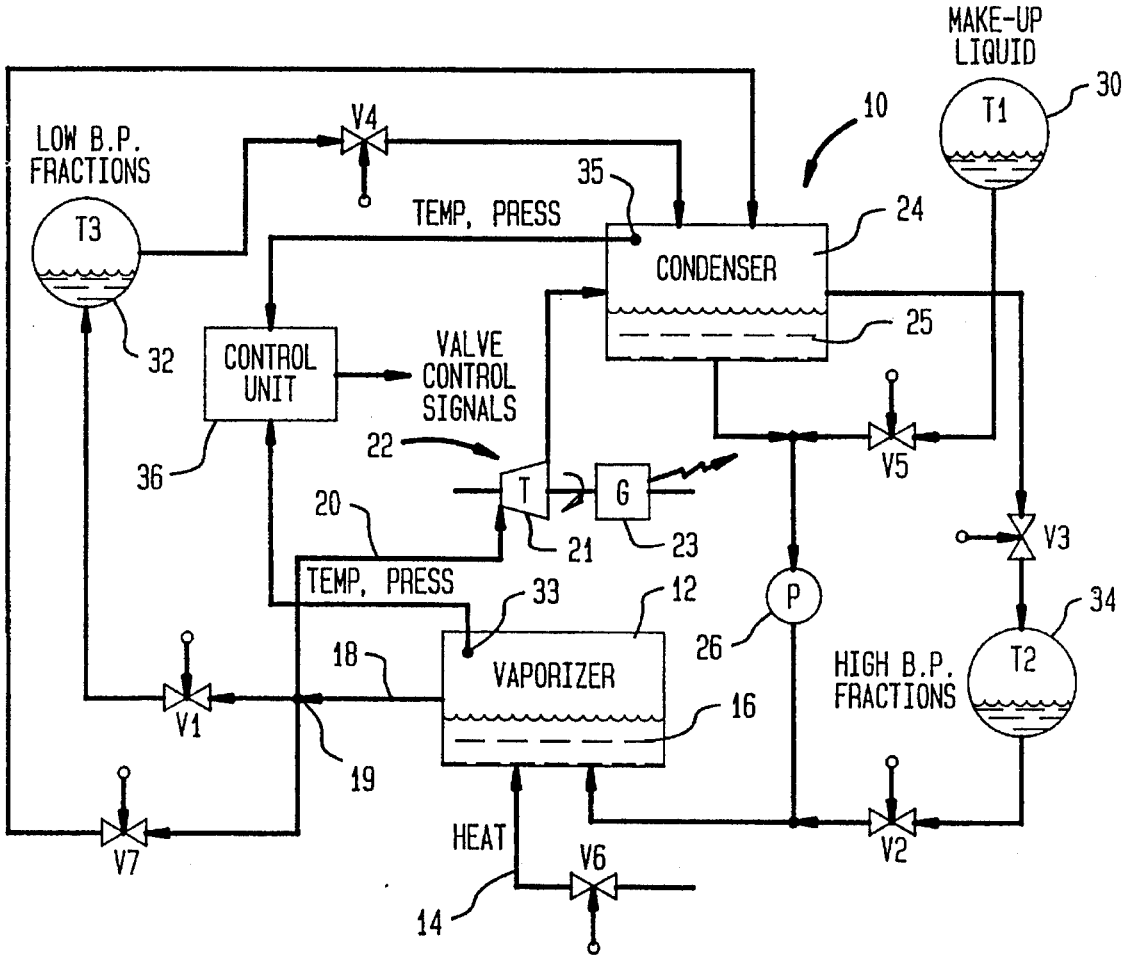
FIG. 1 is a block diagram of an organic fluid Rankine cycle power plant according to the present invention.

Referring now to the drawing, reference numeral 10 designates an organic fluid Rankine cycle power plant according to the present invention. Power plant 10 comprises vaporizer member 12 responsive to heat produced by burner 14 for vaporizing organic working fluid 16 and producing vaporized working fluid in output conduit 18 connected by node 19 to conduit 20 which is connected to the input stage of turbine 21 of turbogenerator 22. The vaporized working fluid expands in turbine 21 producing heat depleted working fluid that is supplied to condenser member 24 where condensation of the heat depleted working fluid takes place. The condenser may be air or water cooled; and condensate 25 in the condenser is returned by pump 26 to the vaporizer to complete the organic fluid cycle. Generator 23 coupled to turbine 21 is driven thereby and the expansion of the working fluid in the turbine produces electricity.

The components and operation described above are entirely conventional, except as to the nature of the working fluid. Prior to the present invention, the working fluid would have been a pure organic fluid, such as pentane, or isopentane having well defined thermodynamic properties that would permit the designer to design the power plant to have a selected power output for a given heat input that would produce a selected mass flow rate of vapor through the turbine. According to the present invention, the working fluid may be a hydrocarbon having a plurality of fractions, such as gasoline, whose properties, and indeed, whose constituents, vary from time to time and place to place because of the variations in the various fractions present in the gasoline.

In order to utilize a hydrocarbon, such as gasoline, make-up tank 30 is employed; and this tank is filled with enough of the hydrocarbon liquid to permit the power plant to be charged with working fluid on start-up. To this end, valve V5 is interposed between tank 30 and pump 26. Therefore, to charge the power plant with working fluid on initial start-up when there is no working fluid in the vaporizer or elsewhere in the plant, valve V5 is opened and pump 26 is operated to draw into vaporizer 12, which is cool, sufficient liquid to fully charge the plant.

Valve V6 is then opened to apply heat to the vaporizer. The low boiling point fractions in the liquid in the vaporizer boil off first by maintaining, if preferred, the temperature in the vaporizer at a lower temperature than the design level until substantially all of the lower boiling points fractions are vaporized. During this time, valve V1 is open, and most of the lower boiling point fractions are piped into holding tank 32. An auxiliary valve (not shown) may block entry of these fractions into the turbine.

To detect the vaporization of the lower boiling point fractions, and to permit such vaporization to be controlled, temperature and pressure sensors indicated by reference numeral 33 may be provided in the vaporizer. When the temperature and pressure sensed by sensor 33 reaches a level that indicates that the lower boiling point fractions have been removed from the liquid in the vaporizer, valve V1 is closed, and the vapors that are then produced are the piped to condenser 24 by opening valve V7.

The vapor that enters the condenser has a temperature and pressure almost equal to the vapor that exits the vaporizer. Condenser 24 effects the condensation of the vaporized working fluid into a liquid. The first portion of the liquid that condenses will be the higher boiling point fractions, and these are conducted to holding tank 34 via open valve V3. By monitoring the temperature and pressure with sensors indicated by reference numeral 35, the cut-off of valve V3 can be established. At this point, the plant can be put into operation. That is to say, valves V1, V2, V3, V4, V5, and V7 are closed; and the working fluid that cycles through the vaporizer, turbine and condenser, is the middle boiling point fractions of the original hydrocarbon in make-up tank 30.

To have the plant operate efficiently, and produce rated power, temperature and pressure in the vaporizer and the condenser can be adjusted to produce the required mass flow rate. These parameters are sensed at 33 and 35; and the values are fed into control unit 36 which can be computer controlled for the purpose of controlling the various valves in the system. Fluids from holding tanks 32 and 34 are valved into the system as it operates to adjust the temperatures and pressures to optimize the electrical output of the power plant. Such operations can be carried out during summer or winter conditions when, for instance, the ambient temperature changes, altering the cooling temperature of the condenser cooling medium such as water or air. These operations are similar to those carried out in U.S. Pat. No. 3,842,593, the subject matter of which is hereby incorporated by reference. Thus, if in summer, for example, when the ambient temperature rises, bringing about an increase in the temperature of the condenser cooling medium, more high boiling point temperature fractions can be introduced into the system. On the other hand, in winter, for example, when the ambient temperature decreases, causing a decrease in the temperature of the condenser cooling medium, more low boiling point fractions can be introduced into the system.

Figure 2:
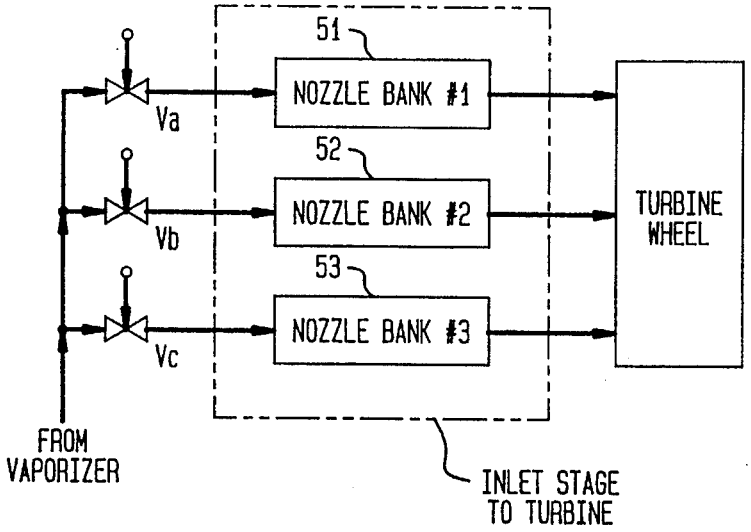
FIG. 2 is a schematic representation of a technique, according to the present invention, for maintaining rated power output of the power plant of FIG. 1 by providing for adjustment to the mass flow of working fluid.

Alternatively, or in addition, the arrangement shown in FIG. 2 can be utilized. In this case, the inlet stage of the turbine is provided with a plurality of separate nozzle banks 51, 52, 53 fed from the vaporizer through individually controllable valves Va, Vb, Vc. These valves are controlled by control unit 36 such that the percent admission to the turbine is controlled in a way that optimizes the output of the plant.

Figure 3:
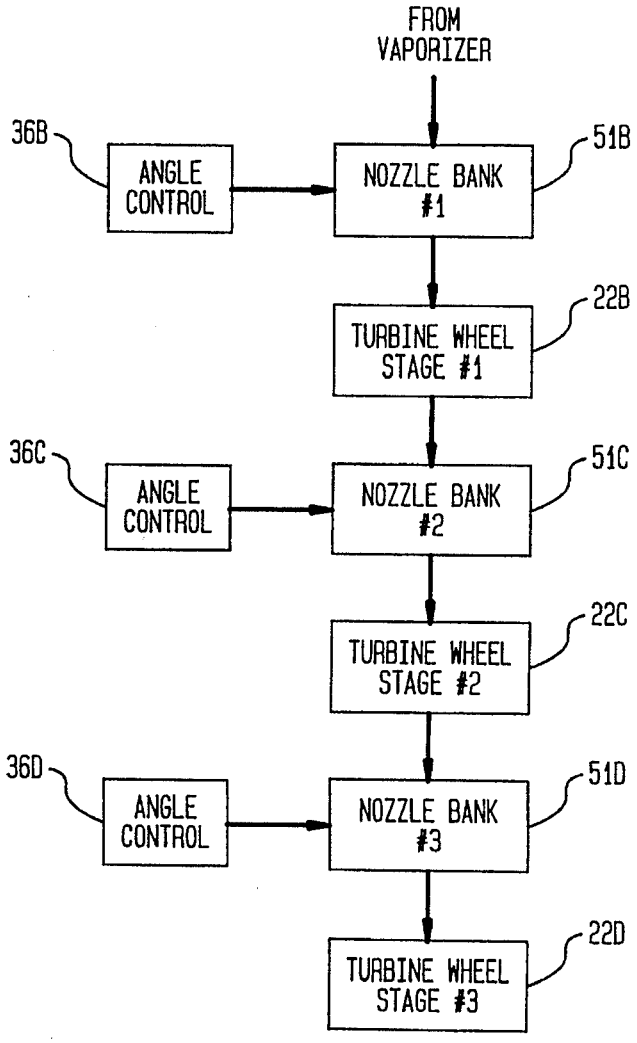
FIG. 3 is a schematic representation of another technique, according to the present invention, for maintaining rated power output to the power plant of FIG. 1 by providing for adjustment to the mass flow of working fluid.

In a further option, the arrangement shown in FIG. 3 can be used. Here, inlet stage 22B of a turbine is provided with nozzle bank 51B fed with vapor produced by vaporizer 12. Vapor exiting stage 22B passes via nozzle bank 51C to a further stage 22C of the turbine. The vapor that exits from the last mentioned stage flows to stage 22D via nozzle bank 51D. The exit angles of nozzle banks 51B, 51C, and 51D are adjustable, the angles being set by controls 36B, 36C, and 36D, respectively, in order to control the pressure drop, and consequently the mass flow rate in the various stages.

While a conventional burner burning fuel is shown as the heat source for the power plant, other types of heat sources, such as geothermal fluids, could also be used with the present invention.

The advantages and improved results furnished by the method and apparatus of the present invention are apparent from the foregoing description of the preferred embodiments of the invention. Various changes and modifications may be made without departing from the spirit and scope of the invention as described in the appended claims.

I claim:

1. A method for operating a Rankine cycle power plant of the type having a vaporizer member responsive to heat input for vaporizing a working fluid and producing vaporized working fluid, a turbogenerator responsive to vaporized working fluid for generating power and producing heat depleted working fluid, a condenser member responsive to said heat depleted working fluid for condensing the same and producing condensate, and means for returning said condensate to the vaporizer, said method comprising:

a) providing a liquid having a plurality of fractions;

b) distilling at least one fraction from said liquid to produce a distillated fluid; and c) supplying said distillated fluid to said power plant as the working fluid;

d) operating the power plant with said liquid;

e) using a member of the power plant for distilling a fraction from said liquid to produce said distillated fluid; and f) removing the last mentioned fraction from said power plant, and thereafter operating the same with said distillated fluid.

2. A method according to claim 1 wherein the member used for distilling a fraction from said liquid is the vaporizer member.

3. A method according to claim 2 wherein said liquid is gasoline.

4. A method according to claim 1 wherein the member used for distilling a fraction from said liquid is the condenser member.

5. A method according to claim 4 wherein said liquid is gasoline.

6. A method for operating a Rankine cycle power plant of the type having a vaporizer member responsive to heat input for vaporizing a working fluid and producing vaporized working fluid, a turbogenerator responsive to vaporized working fluid for generating power and producing heat depleted working fluid, a condenser member responsive to said heat depleted working fluid for condensing the same and producing condensate, and means for returning said condensate to the vaporizer, said method comprising:

a) providing a liquid having a plurality of fractions;

b) distilling at least one fraction from said liquid to produce a distillated fluid; and c) supplying said distillated fluid to said power plant as the working fluid;

d) operating the power plant with said liquid;

e) using a member of the power plant for distilling higher and lower boiling point fractions from said liquid to produce said distillated fluid; and f) removing said higher and lower boiling point fractions from said power plant, and thereafter operating the same with said distillated fluid.

7. A method according to claim 6 wherein said liquid is gasoline.

8. A method according to claim 6 comprising:

a) monitoring the temperature and pressure in the members; and b) changing the amount of said fractions in said distillated fluid in accordance with the monitored temperature and pressure in said members such that the volume flow through the power plant is kept substantially constant.

9. A method according to claim 6, wherein said turbogenerator has adjustable parameters that control the power output, said method comprising:

a) monitoring the temperature and pressure in the members; and b) adjusting a parameter of the turbogenerator in accordance with the monitored temperature and pressure in the members such that the volume flow through the power plant is kept substantially constant.

10. A method according to claim 6 comprising adding said liquid to the vaporizer member, heating the vaporizer member to distill a fraction from the liquid in the vaporizer member, and removing the distilled fraction from the power plant.

11. A Rankine cycle power plant comprising:

a) a vaporizer member responsive to heat input for vaporizing a working fluid and producing a vaporized working fluid;

b) a turbogenerator responsive to vaporized working fluid for generating power and producing heat depleted working fluid;

c) a condenser member responsive to said heat to depleted working fluid for condensing the same and producing condensate;

d) means for returning said condensate to the vaporizer;

e) a make-up tank for storing a liquid having a plurality of fractions;

f) means for supplying liquid from the make-up tank to said power plant;

g) means associated with said vaporizer member for removing from the liquid in the vaporizer member, fractions whose boiling points are greater than a predetermined value;

h) means associated with said condenser for removing from the liquid in the condenser, fractions whose boiling points are lower than a predetermined value; and i) storage means for storing the removed fractions in liquid form.

12. Apparatus according to claim 11 comprising:

a) means for monitoring the temperature and pressure in the members; and b) means for selectively exchanging liquid between the storage means and the vaporizer member in response to the monitored temperature in order to maintain the power output of the turbogenerator.

13. Apparatus according to claim 12, wherein said working fluid is a hydrocarbon.

14. Apparatus according to claim 12, wherein said working fluid is gasoline.

15. A method for operating a Rankine cycle power plant of the type having a vaporizer member responsive to heat input for vaporizing a working fluid and producing vaporized working fluid, a turbogenerator responsive to vaporized working fluid for generating power and producing heat depleted working fluid, a condenser member responsive to said heat depleted working fluid for condensing the same and producing condensate, and means for returning said condensate to the vaporizer, said method comprising the steps of:

a) providing a liquid having a plurality of fractions;

b) distilling at least one fraction from said liquid to produce a distillated fluid; and c) supplying said distillated fluid to said power plant as the working fluid;

d) transferring some of said liquid to said vaporizer member;

e) heating the vaporizer member such that only low boiling point fractions of the liquid in the vaporizer member are vaporized;

f) transferring said low boiling point fractions to a storage tank to thereby separate the low boiling point from the liquid in the vaporizer.

16. A method according to claim 15 comprising the steps of further heating the vaporizer member such that high boiling point fractions of the liquid in the vaporizer member are vaporized; transferring the high boiling point fractions to the condenser member; cooling the condenser member to condense some of the high boiling point fractions to form a condensate; and transferring the condensate to a storage tank.

17. A method for operating a Rankine cycle power plant of the type having a vaporizer member responsive to heat input for vaporizing a working fluid and producing vaporized working fluid, a turbogenerator responsive to vaporized working fluid for generating power and producing heat depleted working fluid, a condenser member responsive to said heat depleted working fluid for condensing the same and producing condensate, and means for returning said condensate to the vaporizer, said method comprising the steps of:

a) providing a liquid having a plurality of fractions;

b) using said members for distilling said liquid into a plurality of distillated fluids; and c) utilizing less than all of said distillated fluids in said power plant as the working fluid and storing the rest of said distillated fluids.

18. A method according to claim 17 including the step of using heat from a source other than said liquid for effecting the distilling of at least one fraction.

19. A method according to claim 17 wherein fluids with boiling points higher than the boiling points of the working fluid are stored separately from fluids with boiling points lower than the boiling points of the working fluid.

20. A method according to claim 17 wherein fluids with boiling points lower than the boiling points of the working fluid are derived from the vaporizer member when said liquid is distilled by said members.

21. A method according to claim 17 wherein fluids with boiling points higher than the boiling points of the working fluid are derived from the condenser member when said liquid is distilled by said members.

22. A method according to claim 17 wherein fluids with boiling points lower than the boiling points of the working fluid are derived from the vaporizer member when said liquid is distilled by said members, and wherein fluids with boiling points higher than the boiling points of the working fluid are derived from the condenser member when said liquid is distilled by said members.

23. A method according to claim 17 wherein said liquid is gasoline.

24. Apparatus according to claim 11 comprising:

a) means for monitoring the temperature and pressure in the members; and b) means for selectively exchanging liquid between the storage means and the vaporizer member in response to the monitored temperature and pressure.

25. A method according to claim 17 comprising:

a) monitoring the temperature and pressure in the members; and b) changing the amount of said fractions in said distillated fluid in accordance with the monitored temperature and pressure in said members such that the volume flow through the power plant is kept substantially constant.

26. A method according to claim 19, wherein said turbogenerator has adjustable parameters that control the power output, said method comprising:

a) monitoring the temperature and pressure in the members; and b) adjusting a parameter of the turbogenerator in accordance with the monitored temperature and pressure in the members such that the volume flow through the power plant is kept substantially constant.

27. A method according to claim 17 comprising:

a) monitoring the temperature and pressure in the members; and b) changing the amount of said fractions in said distillated fluid in accordance with the monitored temperature and pressure in said members such that the volume flow through the power plant is optimized.

28. A method according to claim 17, wherein said turbogenerator has adjustable parameters that control the power output, said method comprising:

a) monitoring the temperature and pressure in the members; and b) adjusting a parameter of the turbogenerator in accordance with the monitored temperature and pressure in the members such that the volume flow through the power plant is optimized.

29. A method for operating a Rankine cycle power plant of the type having a vaporizer member responsive to heat input for vaporizing a working fluid and producing vaporized working fluid, a turbogenerator responsive to vaporized working fluid for generating power and producing heat depleted working fluid, a condenser member responsive to said heat depleted working fluid for condensing the same and producing condensate, and means for returning said condensate to the vaporizer, said method comprising the steps of:

a) providing a liquid having a plurality of fractions;

b) using at least one of the members for extracting at least one fraction from said liquid thereby producing a residual liquid;

c) storing the extracted fraction; and d) using the residual liquid as the working fluid of the power plant.

30. A method according to claim 29 wherein said vaporizer member is used for extracting lower boiling point fractions.

31. A method according to claim 29 wherein said condenser member is used for extracting higher boiling point fractions.

32. A method according to claim 29 wherein said vaporizer member is used for extracting lower boiling point fractions, and said condenser member is used for extracting higher boiling point fractions from said liquid to thereby produce said residual liquid.

* * * * *